US005201331A

United States Patent [19]

Tapper

[11] Patent Number: 5,201,331

[45] Date of Patent: Apr. 13, 1993

[54] VAPOR CONTAINMENT APPARATUS AND METHOD

[75] Inventor: Lee C. Tapper, Kosciusko, Ind.

[73] Assignee: R. R. Donnelley & Sons Co., Lisle, Ill.

[21] Appl. No.: 666,571

[22] Filed: Mar. 8, 1991

[51] Int. Cl.[5] ..... B08B 3/04

[52] U.S. Cl. ..... 134/104.2; 134/108; 134/166 C; 134/169 C; 134/170; 134/200; 118/302

[58] Field of Search ..... 134/170, 199, 200, 166 C, 134/169 C, 54, 55, 104.2, 166 R, 169 R, 108; 118/302; 101/423, 424, 425

[56] References Cited

U.S. PATENT DOCUMENTS

| | | | |
|---|---|---|---|
| 620,224 | 2/1899 | Bubser | 134/199 UX |
| 2,682,273 | 6/1954 | Roach . | |
| 2,745,418 | 5/1956 | Balcom et al. . | |
| 3,025,863 | 3/1962 | Eberle | 134/169 R X |
| 3,227,078 | 1/1966 | Johnson . | |
| 3,319,638 | 5/1967 | Ellison | 134/169 R X |
| 3,402,857 | 9/1968 | Ecklund et al. . | |
| 3,711,796 | 1/1973 | Saito et al. | 101/425 X |
| 3,896,730 | 7/1975 | Garrett et al. | 101/425 |
| 3,974,768 | 8/1976 | Grobman . | |
| 4,175,489 | 11/1979 | Gattus | 101/425 X |
| 4,722,273 | 2/1988 | Jahn | 101/142 |
| 4,923,522 | 5/1990 | Sowers . | |
| 4,934,393 | 6/1990 | Lighthall et al. | 134/166 C X |
| 5,025,818 | 6/1991 | Kalar | 134/170 |
| 5,056,948 | 10/1991 | Puder et al. | 134/111 |
| 5,081,731 | 1/1992 | Yamakita et al. | 118/302 |

*Primary Examiner*—Frankie L. Stinson

*Attorney, Agent, or Firm*—Wood, Phillips, Van Santen, Hoffman & Ertel

[57] ABSTRACT

A vapor containment apparatus for washing an ink pump and sucker tube with a volatile ink solvent has a closed receptacle with a liquid solvent sump. An elongated sleeve encases the sucker tube within the receptacle and positions an inlet end of the sucker tube in the sump. A solvent applicator directs solvent into contact with an outer surface of the sucker tube to drain into the sump and wash the outer surface. An solvent return tube delivers solvent from the ink pump to the sump such that solvent can be drawn through the sucker tube and the pump to wash the pump and the inner surface of the sucker tube. A vacuum exhaust draws solvent vapor through openings on the elongated sleeve and the return tube and evacuates the vapor from the closed receptacle.

6 Claims, 4 Drawing Sheets

Fig. 1
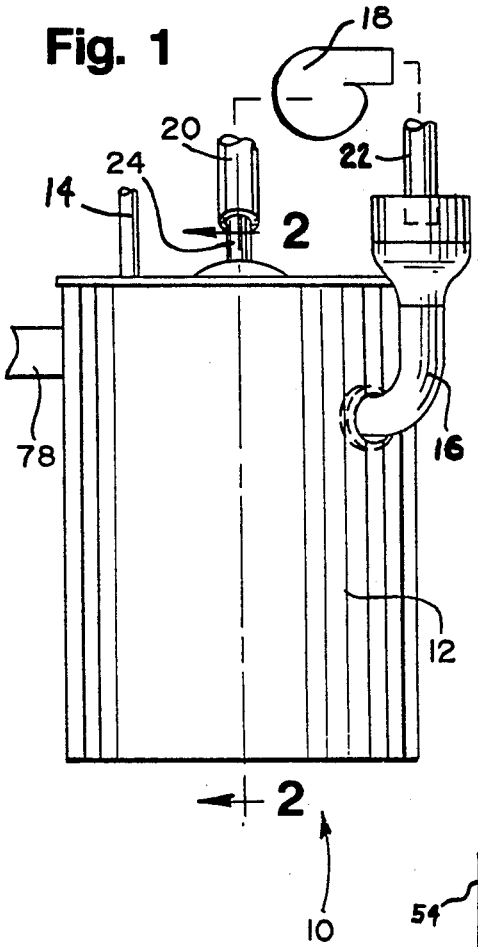
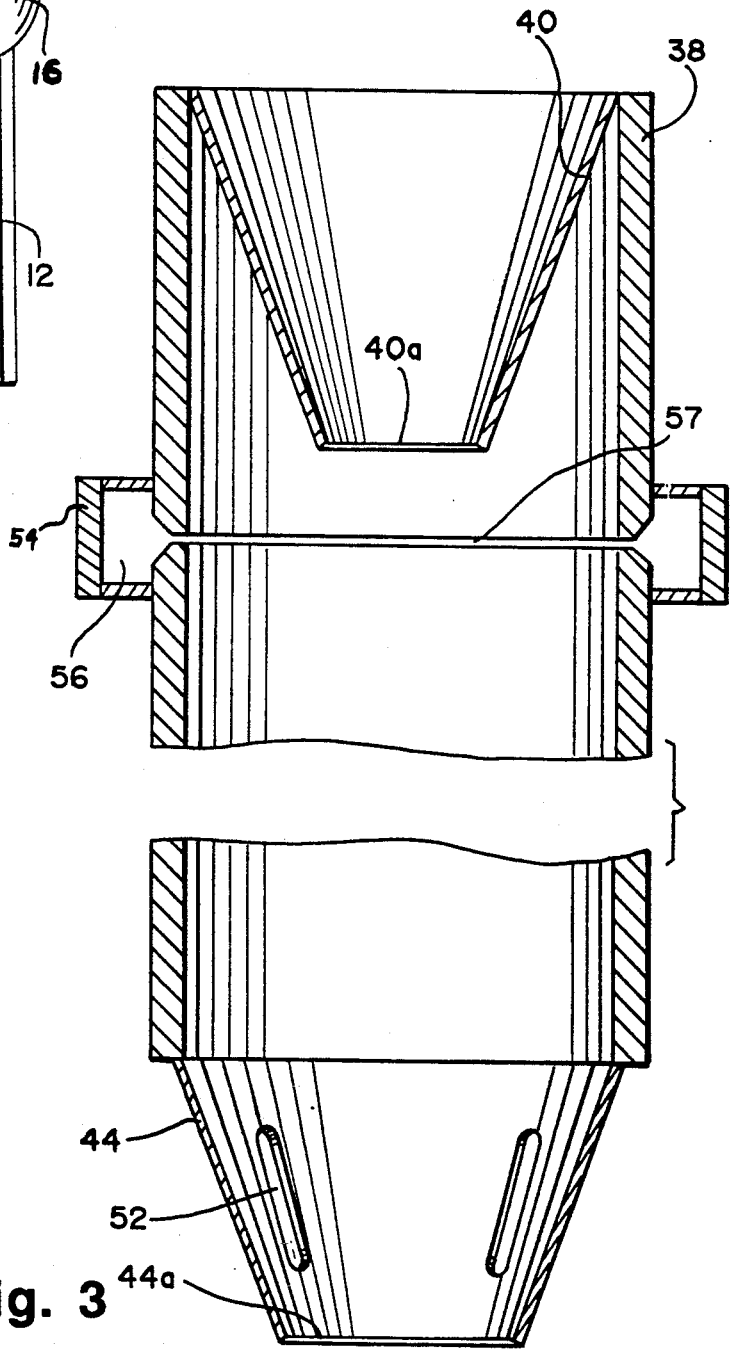
Fig. 3

VAPOR CONTAINMENT APPARATUS AND METHOD

BACKGROUND OF THE INVENTION

1. Technical Field

The present invention is concerned with a vapor containment apparatus and method which reduce the amount of solvent vapor released during the washing of an ink pump and an ink pump sucker tube.

2. Background Art

In the printing industry, inks of many different colors are received at a printing facility in fifty-five gallon drums and are transferred to smaller and more transportable ink buggies for delivering the ink to different locations within the facility. In order to distribute different colored inks among the ink buggies, a transfer pump pumps ink through a sucker tube and a suction line from an ink drum to an ink buggy. To prevent contamination of the ink, the pump, sucker tube, and suction line must be flushed with a solvent prior to pumping different colored inks. Because of the volatile vapor released by the solvents commonly used, it is important to protect an operator from being exposed to the vapor during the flushing procedure.

Prior to the present invention, an apparatus to contain the vapor released during flushing of ink pumps or sucker tubes has not been shown. Numerous devices have been proposed for washing paint guns in a closed container, such as those shown in U.S. Pat. Nos. 2,682,273 to Roach, Balcom et al 2,745,418, and Sowers 4,923,522. None of these devices provide the capability of flushing a sucker tube or a pump.

SUMMARY OF THE INVENTION

In the exemplary embodiment of the invention, a vapor containment apparatus includes a closed receptacle having a liquid solvent sump and an elongated sleeve mounted within the receptacle. The sucker tube is received in the sleeve with an inlet end of the tube immersed in the sump. The ink pump draws solvent from the sump through the sucker tube to wash the interior surface of the sucker tube.

A solvent applicator is mounted on the sleeve and connected with a source of volatile liquid ink solvent for directing solvent onto an outer surface of the sucker tube. The solvent drains along the sucker tube into the sump to wash the exterior of the sucker tube. The solvent applicator is an annular collar which circumscribes a portion of the sleeve and has an internal passageway for receiving solvent under pressure. The portion of the sleeve about which the collar extends has a circumferential slit which directs pressurized solvent in the internal passageway onto the sucker tube.

An inclined tube within the closed receptacle has an inlet extending outside of the receptacle and delivers solvent from the pump to the liquid solvent sump. Delivery through the inclined tube prevents the free-fall of solvent as the solvent flows toward the sump to reduce the amount of solvent which is vaporized within the receptacle. The inlet end has a funnel connected to the inclined tube with a T-coupling. An opening is provided in the coupling for escape of solvent vapor contained within the inclined tube to the interior of the closed receptacle.

An exhaust duct is connected to a source of vacuum and conducts solvent vapor away from the containment apparatus to a remote discharge. Axially extending slits in the elongated sleeve allow air flow to draw solvent vapor from the sleeve through the interior of the closed receptacle for evacuation through the exhaust duct.

The present invention also comprehends a method for reducing the escape of solvent vapor while washing an ink pump and sucker tube with a volatile ink solvent. The method consists of the steps of first providing a closed receptacle having a liquid solvent sump. The sucker tube is positioned in the receptacle with an inlet end of the tube immersed in solvent in the sump. Liquid solvent is then directed onto the outer surface of the sucker tube to wash the tube and drain into the sump. The pump is operated to draw liquid solvent from the sump through the sucker tube and the pump. Solvent vapor is drawn from the closed receptacle as by a vacuum.

In one aspect of the method, solvent from the pump is returned in a continuous cycle.

In another aspect of the method, contaminated solvent is discharged from the apparatus rather than being returned to the sump. Clean solvent is supplied to the sump.

BRIEF DESCRIPTION OF THE DRAWINGS

The features of this invention which are believed to be novel are set forth with particularity in the appended claims. The invention will be apparent from the following description taken in conjunction with the accompanying drawings wherein:

FIG. 1 is diagramatic illustration of a vapor containment apparatus according to the present invention;

FIG. 3 is an enlarged broken section of the elongated sleeve shown in FIG. 2;

DETAILED DESCRIPTION OF THE INVENTION

Figure 2:
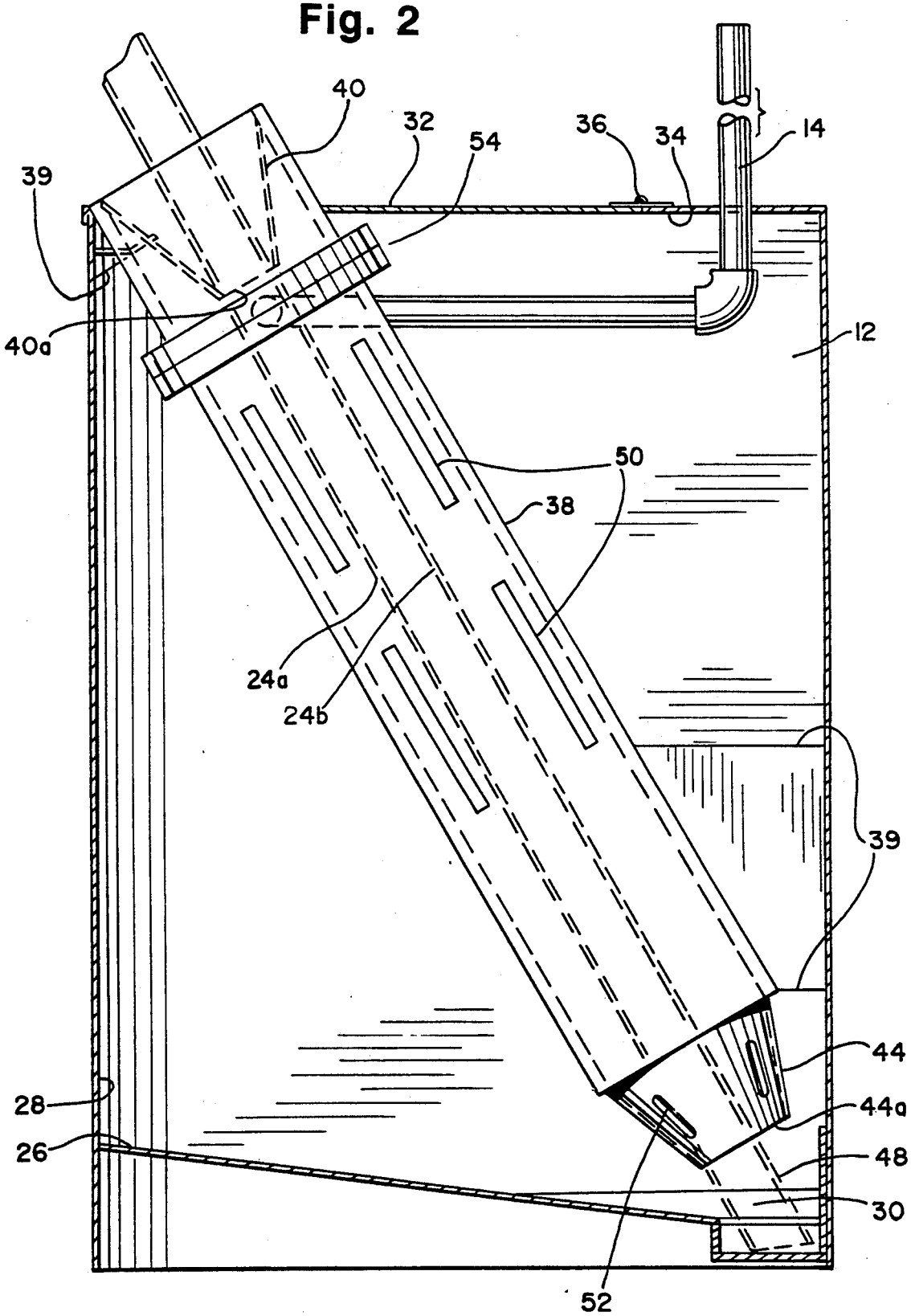
FIG. 2 is a vertical section take along line 2-2 of the apparatus shown in FIG. 1 and illustrating a sucker tube positioned within the closed receptacle.

Referring first to FIG. 1, a vapor containment apparatus is shown generally at 10, having a closed receptacle 12 from which a solvent inlet tube 14 and a solvent return 16 extend. An ink pump, shown schematically at 18, is interconnected between a suction line 20 and a discharge line 22 for transferring ink. Suction line 20 terminates in a sucker tube 24, which is inserted into closed receptacle 12 for washing, while discharge line 22 directs solvent into return tube 16 for delivering solvent from the pump to the interior of receptacle 12, as will be described.

As shown in FIG. 2, receptacle 12 has a ramped bottom interior surface 26 which extends from a side 28 of receptacle 12 downwardly to a liquid sump 30 which stores surplus solvent. A cover 32 is provided on a top surface 34 of receptacle 12 which, by means of a hinge 36 may be opened to provide access to the interior of the receptacle.

An elongated cylindrical sleeve 38 extends through cover 32 at one end and is inclined downwards toward the sump 30. Sleeve 38 is supported within closed receptacle 12 by a plurality of gusset plates 39. A conical support member 40 extends inwardly of an end 42 of the sleeve. A second conical member 44 extends outwardly of an opposite end 46 of the sleeve. Each of conical members 40 and 44 has a central aperture 40a and 44a, respectively, for receiving a portion of sucker tube 24. Sucker tube 24 is encased within sleeve 38 and is positioned with a lower sucker tube end 48 immersed in sump 30. A plurality of axially extending slits 50 are formed along elongated sleeve 38 and a plurality of axially extending slits 52 are provided on the lower conical member 44. Slit 50 and 52 communicate a flow of air from within sleeve 38 with the interior of closed receptacle 12.

A solvent applicator in the form of an annular collar 54 circumscribes a portion of elongated sleeve 38 and has an annular internal passageway 56. Solvent inlet tube 14 communicates with internal passageway 56 and provides pressurized solvent thereto. Sleeve 38 has a circumferential slit 57 formed within the internal passageway of annular collar 54. Slit 57 is approximately ⅛ inch wide and forms an annular nozzle through which solvent is directed from the internal passageway 56 against an outer surface 24a of sucker tube 24 encased within the sleeve. Solvent drains downwardly along outer sucker tube surface 24a toward sump 30 to wash the outer surface of the sucker tube without splashing and generating excess solvent vapor.

Figure 4:
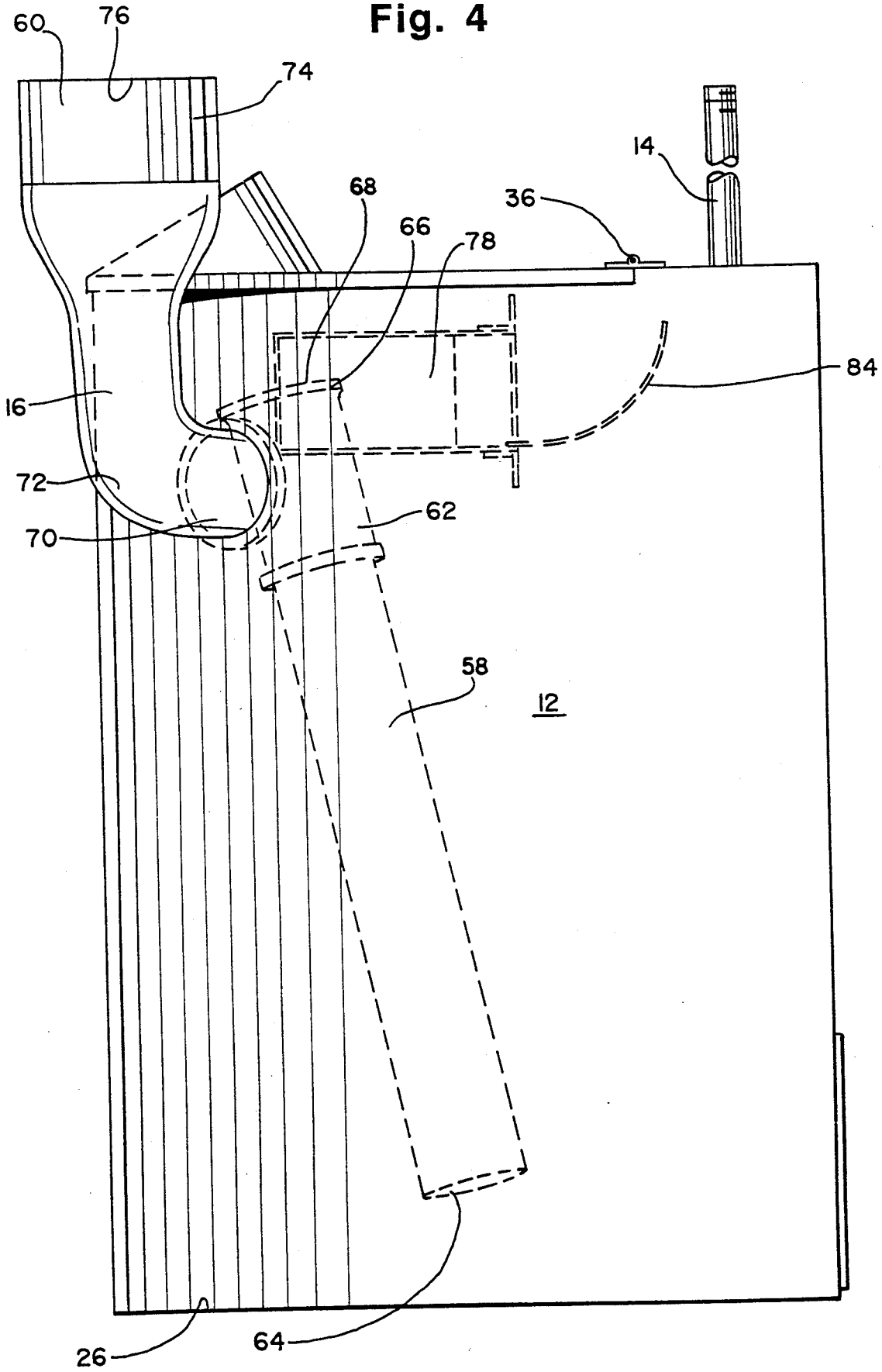
FIG. 4 is an external side view of the apparatus shown in FIG. 1 and showing in detail the solvent return means.

Referring now to FIG. 4, solvent return 16 has an inclined tube 58 mounted within closed receptacle 12 and is connected with an exterior return basin 60 by means of a T-coupling 62. Inclined tube 58 extends downwardly within receptacle 12 to a lower open end 64 near ramped bottom surface 26. An upper end 66 of T-coupling 62 has an opening 68 through which solvent vapor in inclined tube 58 is communicated to the interior of closed receptacle 12. A lateral opening 70 on T-coupling 62 engages an upwardly curved elbow 72 on the exterior of receptacle 12, which terminates in a flared funnel 74. Funnel 74 has an opening 76 through which discharge line 22 returns solvent from pump 18 to inclined tube 58 and the liquid solvent sump 30.

Figure 5:
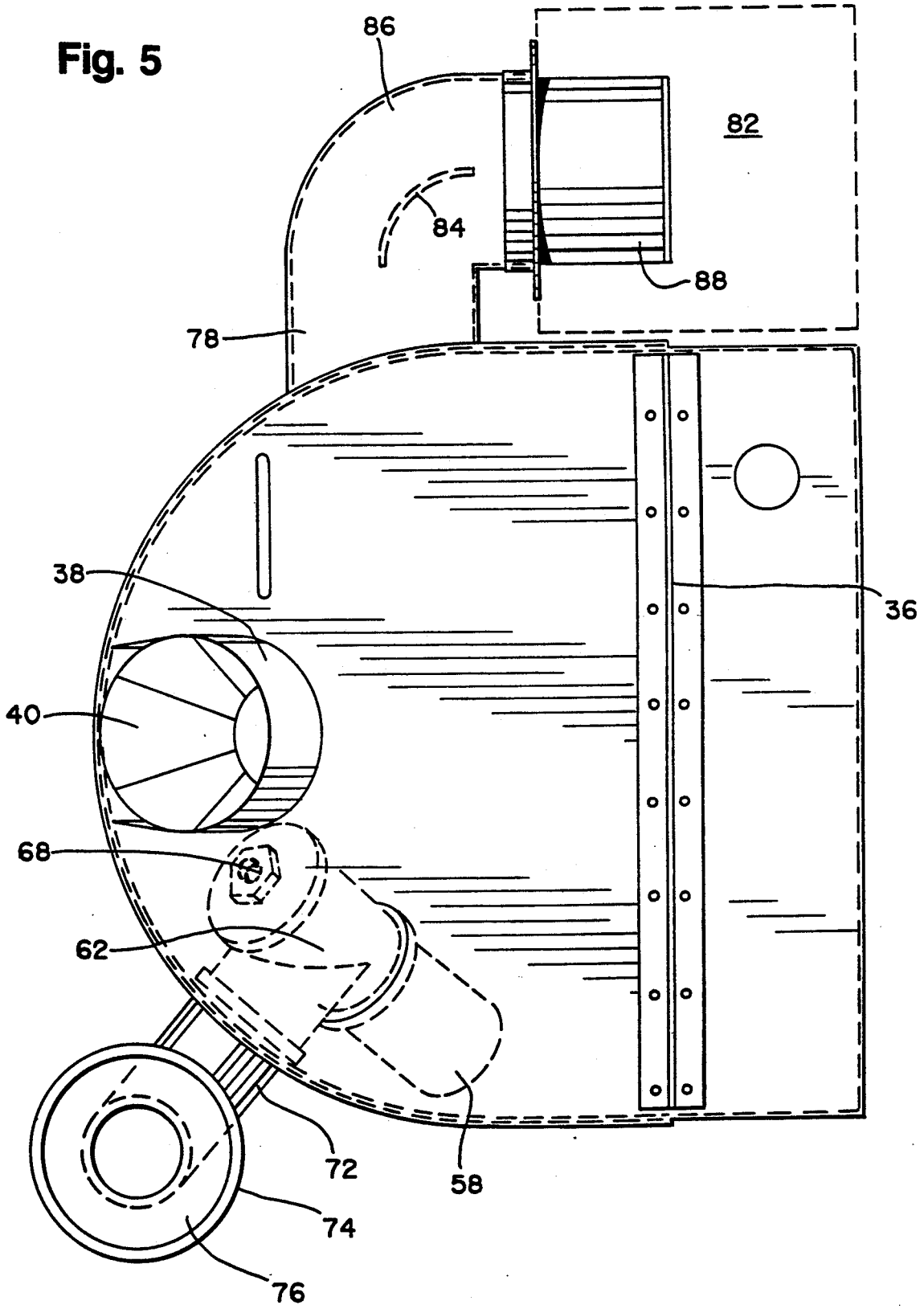
FIG. 5 is a top elevational view of the apparatus shown in FIG. 1.

A tubular exhaust duct 78, best shown in FIG. 5, extends laterally from closed receptacle 12 and terminates at an outlet end 80 connected to an external exhaust duct 82. Exhaust duct 82 communicates with a source of vacuum pressure for drawing solvent vapor from the interior of the closed receptacle 12 and through duct 78. Vapor is routed through duct 82 and discharged remotely from the vapor containment apparatus. A curved turning vane 84 is disposed within a complementary elbow 86 in duct 78 to enhance the evacuation of solvent vapor from the receptacle, and an upturned air deflector 88 extends from outlet end 80 of the duct to direct exiting vapor toward external exhaust duct 82.

The operation of the vapor containment apparatus may be briefly summarized as follows. An ink pump sucker tube is inserted through apertures 40a and 44a in cylindrical sleeve 38 such that lower sucker tube end 48 is immersed in sump 30. Solvent is introduced under pressure through solvent inlet tube 14 into internal passageway 56 in the annular applicator collar 54. Solvent is directed through nozzle 57, against outer surface 24a of the sucker tube, and drains downwardly along the outer surface of the sucker tube toward the sump to wash the outer sucker tube surface without generating excess vapor.

Pump 18 draws solvent upwardly from sump 30 through sucker tube 24 to wash inner sucker tube surface 24b and the pump interior. Solvent is pumped away from the pump through discharge line 22 and directed into return basin 60. Solvent flows downwardly through inclined tube 58 to ramped bottom surface 26, where it drains into sump 30. The inclination of tube 58 prevents the free fall of returned solvent in the receptacle to reduce vaporization. Solvent is continuously drawn through the sucker tube and the pump in a closed-loop cycle until the solvent is too contaminated to effectively wash the sucker tube and pump. At that point, discharge line 22 is directed toward a solvent discharge station (not shown) to purge the contaminated solvent and clean solvent is introduced through the opened cover 32.

The vacuum in external exhaust duct 82 creates a suction within the closed receptacle 12 and continuously draws away solvent vapor. The suction draws a flow of air through the aperture 40a and elongate sleeve 38 around the sucker tube. The flow moves outwardly through axial slits 50 and 52 into the interior of the receptacle 12 to flush solvent vapor from the sleeve 38. Air is also drawn through openings 64 and 68 in tube 58 to flush vapor from the tube, T-coupling 62, and return basin 60. The solvent vapor is exhausted through ducts 78 and 82 and discharged in a suitable remote location.

I claim:

1. A vapor containment apparatus for washing an ink pump and sucker tube with a volatile ink solvent, the pump having an inlet connected with the sucker tube and an outlet, the sucker tube being elongated and having an inlet end, the apparatus comprising:

a closed receptacle having a liquid solvent sump;

an inclined sleeve in the closed receptacle and receiving the sucker tube, said sleeve positioning the inlet end of the sucker tube in said sump for the pump to draw solvent therefrom through the sucker tube, washing the interior surface of the sucker tube and the pump;

a source of volatile liquid ink solvent;

a solvent applicator connected with said source and positioned to direct solvent onto the outer surface of the sucker tube inside the sleeve, the solvent washing the outer surface of the sucker tube and draining into said sump;

means for receiving liquid solvent from the outlet of said pump; and means for evacuating solvent vapor from within the inclined sleeve and exhausting solvent vapor from the receptacle.

2. The vapor containment apparatus of claim 1 in which the inclined sleeve extends between spaced apart ends, with at least one end having a conical member with a central aperture for receiving and positioning the sucker tube.

3. The vapor containment apparatus of claim 1 in which the means for evacuating solvent vapor from the within the inclined sleeve comprises a plurality of openings in said inclined sleeve which allow solvent vapor contained within the sleeve to be evacuated during exhausting of the closed receptacle.

4. The vapor containment apparatus of claim 3 in which the openings on the inclined sleeve are axially extending slits.

5. The vapor containment apparatus of claim 1 including solvent return means for delivering solvent from the pump outlet to the liquid solvent sump, said solvent return means comprising a return tube disposed within the closed receptacle and having an inlet at one end extending outside the receptacle.

6. The vapor containment apparatus of claim 5 in which the solvent return means has an opening in the closed receptacle which allows solvent vapor contained within the return tube to pass to the interior of the closed receptacle.

* * * * *